United States Patent [19]

Yoshio

[11] 4,188,240

[45] Feb. 12, 1980

[54] METHOD FOR PRODUCING A METAL LAYER BY PLATING

[75] Inventor: Akira Yoshio, Tokyo, Japan

[73] Assignee: Sony Corporation, Tokyo, Japan

[21] Appl. No.: 939,194

[22] Filed: Sep. 5, 1978

[30] Foreign Application Priority Data

Sep. 5, 1977 [JP] Japan ..... 52-106445

[51] Int. Cl.[2] ..... C23F 7/02; B29D 17/00

[52] U.S. Cl. ..... 148/6.14 R; 204/5; 264/107

[58] Field of Search ..... 148/6.14 R; 204/5, 4, 204/6, 8, 38 B, 32 R, 32 S, 29; 264/107

[56] References Cited

U.S. PATENT DOCUMENTS 2,530,842 11/1950 Ruggieri ..... 204/5

FOREIGN PATENT DOCUMENTS 2120327 11/1971 Fed. Rep. of Germany ..... 427/304

*Primary Examiner*—Ralph S. Kendall

*Attorney, Agent, or Firm*—Lewis H. Eslinger; Alvin Sinderbrand

[57] ABSTRACT

The metallic surface of a master plate or mother plate is oxidized in a solution of hypochlorite to form a parting layer upon which a metal layer is plated. The metal layer may be stripped from the master plate or mother plate aided by the parting layer to form a matrix or stamper from which a plastic record disc, such as, a video disc, can be molded.

6 Claims, 7 Drawing Figures

METHOD FOR PRODUCING A METAL LAYER BY PLATING

BACKGROUND OF THE INVENTION

1. Field of the Invention

This invention relates to a method for producing a removable metal layer by plating, more particularly, to an improved electro-plating method which is suitable for making an information-recorded matrix or disc used in the process of manufacturing a video disc.

2. Description of Prior Art

In the conventional process of manufacturing a video disc, a stamper, carrying a negative pattern of the video information on its surface, is manufactured by electroplating a metal layer on a metallic, suitably nickel, mother plate. The stamper is separated from the mother plate after electroplating. Various methods have been used in the prior art to facilitate the separation of the stamper from the mother plate. In one method, a nickel coated mother plate is dipped into a 5 to 10 percent solution of potassium bichromate for several tens of seconds at room temperature until the nickel to be plated is oxidized to form a parting layer. The oxidized surface is then electroplated to form the stamper. The parting layer of oxide permits the stamper to be separated from the mother plate. This method is known as the "bichromate method" and is attractive because it requires no special equipment to perform it. The bichromate method is now being replaced by other methods since it has been found to be the source of pollution by hexavalent chromium. Furthermore, the bichromate method produces dissolution and discoloration of the surface of the mother plate when the solution is too strong and fails to form a satisfactory parting layer when the solution is too weak. There are also few chemical oxidizing agents which have sufficient oxidizing power.

According to another prior art method, of forming a parting layer, the mother plate is dipped into a several percent solution of sodium hydroxide and is subjected to anodic oxidation at a current density of 0.5 to 5 $A/dm^2$ (amperes per decimeter$^2$) normally at 40° to 60° C., whereby an oxide layer of oxidized nickel is formed as a parting layer. This method is known as "anodic oxidation method" and does not create pollution. This method has disadvantage that a bath for the anodic oxidation must be heated to a an elevated temperature and that special electrical equipment for anodic oxidation is required. This method has the further defect that it is hard to uniformly oxidize the entire surface of the mother plate. In addition, the nickel of the mother plate is partially oxidized and dissolved each time the operation is performed. This degrades precise copying.

In both the bichromate methods, and anodic oxidation method, the oxide parting layer formed on the mother plate may become hydrophobic when dry. The oxide layer accordingly repels water and interferes with succeeding washing and electroplating processes. For this reason, an additional process is required to coat a surface active agent on the surface of the oxide layer on the mother plate before electroplating to form the stamper. This additional operation increases the labor and cost of the process.

OBJECTS AND SUMMARY OF THE INVENTION

An object of this invention is to provide an improved method for producing a removable metal layer by plating wherein an oxide parting layer is easily formed on the surface of a substrate with high precision so that highly precise electroplating can be effected on the substrate.

Another object of this invention is to provide an improved method for producing a removable metal layer by plating without a problem of pollution.

In accordance with this invention, a plating process comprises the steps of oxidizing a surface of a substrate to be plated, with hypohalogenite for sufficient time to form an oxide parting layer and then plating the surface of the oxide parting layer.

DESCRIPTION OF THE PREFERRED EMBODIMENT

According to this invention, a hypohalogenite having sufficient oxidizing power for oxiding the metal surface of a mother plate without dissolution and discoloration thereof, is employed to produce an oxide parting layer on the metal surface to be plated. A metal layer is plated over the oxide parting layer to produce a surface which faithfully reproduces the shape of the surface of the mother plate. The plated metal layer is easily separated from the substrate at the oxide parting layer.

A hypohalogenite, for example, NaClO reacts with acid or water to produce NaOH and $Cl_2$ which decomposes into Nacl and $O_2$. These materials produce less damage to the mother plate and easier aftertreatment than the prior art methods and do not present a problem of pollution. A suitable parting layer can be formed merely by dipping the surface of the mother plate to be plated into a solution of hypohalogenite at room temperature. Accordingly, the operation requires no special operating conditons or equipment, and is superior in performance and cost. Because the parting layer obtained by oxidizing with hypohalogenite maintains its hydrophilic property in a dry state, a succeeding treatment such as electroplating can be done without additional pretreatment such as coating with surface active agent.

The above-described hypohalogenite according to this invention may contain a halogen such as Cl, Br or I and a cation such as $Na^+$, $K^+$, $Ca^{2+}$, $Sr^{2+}$, $Ba^{2+}$, $NH_4^+$ or the like. Among these hypohalogenites, hypochlorite, particularly sodium hypochlorite (NaClO) in the form of a strong alkaline solution is preferable in view of the stability of its aqueous solution and its economy.

The substrate to be plated can be a master plate or a mother plate which is used for manufacturing a video disc.

Next, an embodiment of this invention used for the manufacture of the video disc will be described with reference to the accompanying drawings.

Figures 1A, 1B, 1C, 1D:
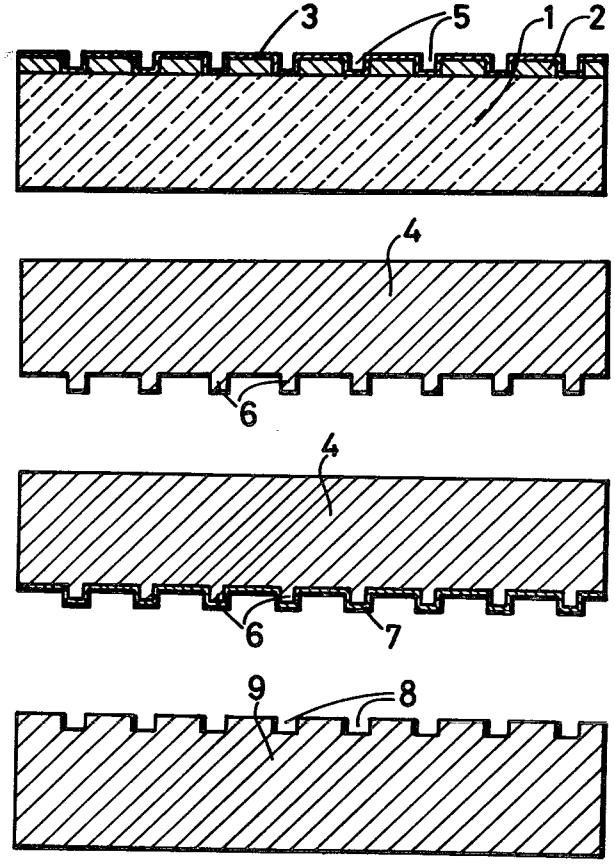
FIGS. 1A to FIG. 1G are cross-sectional of information recording media, showing successive steps in the process of manufacturing a video disc utilizing the method according to this invention.

Referring to FIG. 1A, it will be seen that, in a conventional part of the process, an original or master is made by coating a photoresist layer 2 on a glass plate 1, and then subjecting the photoresist layer 2 to the action of a laser beam modulated with the signal information to be recorded so that, after developing, the photoresist layer 2 has surface irregularities, for example, the illustrated pits 5, which indicate the recorded video or other information signals. A thin metallic layer 3 is deposited on the surface of the photoresist layer 2 by electroless plating after the cutting process.

The metal layer 3 on original plate is subjected to conventional electroplating, preferably nickel plating to produce a master plate 4 shown in FIG. 1B. The deposited nickel master plate 4 is separated from the glass plate 1. Projections 6 on master plate 4 corresponding to record pits 5 of the original plate are formed on the surface of the master plate 4.

10 percent aqueous solution of sodium hypochlorite is prepared and used as an oxidizing bath. After the master plate 4 is washed, it is dipped into the oxidizing bath for long enough, suitably several minutes, at room temperature until a thin oxide parting layer 7 of oxidized nickel is formed on the surface of the master plate 4 as shown in FIG. 1C. The master plate 4 is then washed in water and the surface of the oxide parting layer 7 is subjected to conventional nickel electroplating. The nickel layer deposited on the oxide parting layer 7 by electroplating is separated from the master plate 4 to obtain a mother plate 9 as shown in FIG. 1D. The mother plate 9 has record pits 8 on its surface faithfully reproducing the projections 6 of the master plate 4. On the separation of the mother plate 9, the separating property imparted by the oxide parting layer 7 is sufficiently good and that unevenness in separation and discoloration do not appear. Accordingly, the projections 6 are transferred with high accuracy to form the pits 8 precisely.

Figure 1E:
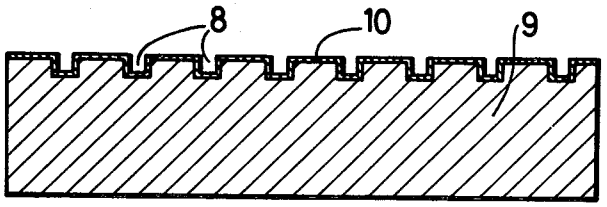
Figure 1F:
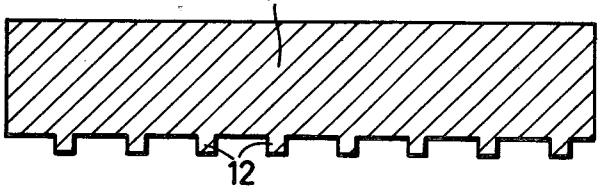

The mother plate 9 is washed in water and dipped into the oxidizing bath for long enough, suitably several minutes at room temperature to form a thin oxide parting layer 10 of oxidized nickel is formed on the surface of the mother plate 9 as shown in FIG. 1E. The oxide parting layer 10 on the mother plate 9 is then washed in water and is electroplated. The layer deposited by electroplating is separated from the mother plate 9 to obtain a stamper 11 which carries a negative pattern of the video information for pressing as shown in FIG. 1F. As before, the oxide parting layer 10 permits separation of the stamper 11 such that the pits 8 of the mother plate 9 are accurately transferred to the stamper 11. Thus, projections 12 are precisely formed on the stamper 11 corresponding to the pits 8 on the mother plate 9. In my experiment, many stampers 11 were manufactured using one mother plate 9. The S/N ratios of the first stamper and the tenth stamper made with the same mother plate 9 were measured. These measurements showed that there was no measureable difference between the two S/N ratios. This indicates that the S/N ratios of the stampers 11 does not measureably deteriorate with succeeding stampers 11 from the same mother plate 9.

Figure 1G:
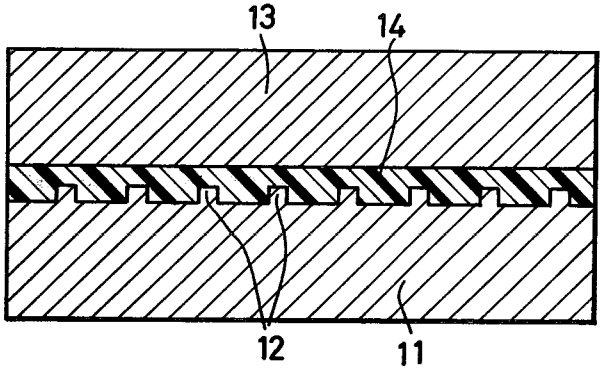

Further, as shown in FIG. 1G, a video disc material layer 14 of any suitable material, but preferably of polyvinyl chloride is put placed between the stamper 11 and a stamper 13. The layer 14 is pressed from both sides so that a replica having record pits corresponding the projections 12 on one surface of the stamper 11 is formed by pressure molding on the surface of the layer 14. The stamper 13 may also have projections, not shown, containing video or other information which produces a replica having record pits in the second side of the disc.

The recorded signal which transferred to the master plate 4 shown in FIG. 1B was reproduced to measure its S/N ratio. The master plate 4 was then dipped into an oxidizing bath of a 10% aqueous solution of sodium hypochlorite. The master plate 4 was taken out of the solution after 30 seconds and washed in water and dried. S/N ratio of thus treated master plate was measured. The same plate was again dipped into the 10% aqueous solution of sodium hypochlorite for 30 seconds, washed, dried and measured. This process was repeated for total immersion times of 1.5, 2.0, 6.0, 6.5 and 8 minutes. The S/N ratio of the master plate oxidized by the oxidizing bath was compared Autiformin with that of an untreated master plate. The following measured results were obtained:

| Treating time (Dipping time) | 0.5 min. | 1.0 min. | 1.5 min. | 2.0 min. | min. | 6.5 min. | 8.0 min. |
|---|---|---|---|---|---|---|---|
| S/N ratio (Deterioration amount) | O | O | O | O | O | O | O |

The mark O in the above data indicates that no measurable S/N ratio deterioration was detected a good result. Under the above of the oxidizing bath and at room temperature, the treating or dipping time of the master plate in the oxidizing bath is preferably 2 to 6 minutes to form the oxide parting layer. According to the above data, it can be understood that the S/N ratio does not deteriorate during treatment times of from 2 to 6 minutes. This shows that the surface of the oxide layer is as flat as that of the untreated disc and does not develop a concave or convex surface.

As described above, according to the plating method of this embodiment, the accuracy of transfer can be improved and a uniform oxide layer can be formed at low cost without special equipment. The thickness of the oxide layer can be controlled by the concentration of the oxidizing bath and the dipping time employed. The plating operation therefore becomes very simple. In addition, in contrast to the conventional bichromate method, the method of this embodiment causes no pollution, and the oxidized surface of the plate is completely hydrophilic so that the plate can be uniformly plated at the initial state of electroplating. In addition to this, the fact that the oxidized surface of the plate maintains its hydrophilic property even after being dried and stored is very desirable since this eliminates the need for a treatment step before resuming electroplating. The cost to perform the process set forth herein is about one-third of that of the conventional method. Further, sodium hypochlorite is readily available on the commercial market and the oxidizing bath made from it has adequate stability.

It will be evident that various modifications can be made in the above-described embodiment without departing from the scope of this invention. For example, the material of the layer to be plated and the plating method may be modified.

This invention is not limited to the manufacture of master or mother plates or stampers for video discs but instead can be applied to any other plating process which requires the separation of a plated layer from a substrate.

What is claimed is:

1. A method for producing a metal layer by plating comprising the steps of:

providing a substrate with a metallic surface to be plated;

oxidizing said metallic surface of said substrate with hypohalogenite for sufficient time to form an oxide parting layer thereon; and plating a metallic layer on a surface of said oxide parting layer.

2. A method according to claim 1, wherein said step of oxidizing said metallic surface of said substrate includes the steps of dipping said surface of said substrate into an aqueous solution of hypochlorite to form said oxide parting layer and washing said substrate and oxide parting layer with water.

3. A method according to claim 1, wherein said hypohalogenite is sodium hypochlorite.

4. A method according to claim 1, wherein said hypohalogenite is selected from the group consisting of a chlorine, bromine or iodine halogen with a cation of sodium, potassium, calcium, strontium, barium or $NH_4$.

5. A method for producing a plastic disc containing recorded information comprising:

producing a master disc with a metallic surface and having said information defined by irregularities of said surface;

oxidizing said metallic surface with hypohalogenite for sufficient time to form an oxide parting layer thereon;

plating a metal layer on said oxide parting layer;

separating said metal layer from said master disc at said parting layer; and pressing a surface of said metal layer against a plastic disc material whereby a plastic disc is formed with a surface of said plastic disc having irregularities which are a replica of said information.

6. A method according to claim 5, wherein said hypohalogenite is sodium hypochloride.

* * * * *